US005716497A

United States Patent [19]

Richter et al.

[11] Patent Number: 5,716,497

[45] Date of Patent: Feb. 10, 1998

[54] METHOD AND DEVICE FOR THE CONTINUOUS COOKING OF PULP

[75] Inventors: Johan Richter, Oslo, Norway; Ole Richter, Karlstad, Sweden

[73] Assignee: Kvaerner Pulping AB, Sweden

[21] Appl. No.: 663,213

[22] PCT Filed: Dec. 21, 1994

[86] PCT No.: PCT/SE94/01230

§ 371 Date: Jun. 12, 1996

§ 102(e) Date: Jun. 12, 1996

[87] PCT Pub. No.: WO95/18261

PCT Pub. Date: Jul. 6, 1995

[30] Foreign Application Priority Data

Dec. 29, 1993 [SE] Sweden ..... 9304333

[51] Int. Cl.[6] ..... D21C 7/00

[52] U.S. Cl. ..... 162/41; 162/19; 162/29; 162/237; 162/242; 162/249; 162/251

[58] Field of Search ..... 162/17, 19, 29, 162/30.1, 33, 34, 41, 233, 237, 242, 249, 251, 263

[56] References Cited

U.S. PATENT DOCUMENTS

| | | | |
|---|---|---|---|
| 4,123,318 | 10/1978 | Sherman | 162/19 |
| 5,053,108 | 10/1991 | Richter | 162/237 |
| 5,080,755 | 1/1992 | Backlund | 162/19 |
| 5,089,086 | 2/1992 | Silander | 162/19 |
| 5,192,396 | 3/1993 | Backlund | 162/19 |
| 5,346,591 | 9/1994 | Henricson | 162/249 |

FOREIGN PATENT DOCUMENTS

| | | |
|---|---|---|
| 0477059A2 | 9/1991 | European Pat. Off. . |
| 8804578 | 12/1988 | Sweden . |
| WO91/05103 | 9/1990 | WIPO . |

*Primary Examiner*—Donald E. Czaja
*Assistant Examiner*—Steven B. Leavitt
*Attorney, Agent, or Firm*—Fasth Law Firm

[57] ABSTRACT

A novel method and device for the production of pulp by a continuous cooking process is provided wherein hot impregnated chips are fed into the top of a countercurrent steam digester which has a bottom outlet and at least one draw off screen girdle for removing black liquor. At least 50%, preferably 70%, of the cooking liquor is fed to the top of the digester as finely divided droplets.

24 Claims, 2 Drawing Sheets

METHOD AND DEVICE FOR THE CONTINUOUS COOKING OF PULP

TECHNICAL FIELD

The present invention relates to a novel method and device for producing pulp, principally sulphate cellulose, with the aid of a continuous cooking process. The method and the device are principally directed towards exploiting, in a steam/liquid-phase digester, the advantages associated with impregnating the chips with the aid of hot black liquor, in accordance with the displacement principle.

STATE OF THE ART AND PROBLEMS

Experiments on black liquor impregnation are already in progress in connection with the production of sulphate cellulose pulp in continuous cooking. These experiments are demonstrating propounded theories, i.e. that impregnation with the aid of black liquor improves the strength properties of the fibres in the pulp produced in this manner. It appears that the principal reason for the improvement in the strength properties of the fibres is the fibre-sparing effect of the black liquor in combination with the relatively late introduction of a rather large quantity of white liquor, as described in all essentials in our own application EP 91402350.

If, as is customary, a large proportion of white liquor is used in connection with the impregnation, this results in certain fibres being exposed to the aggressive effect of the white liquor, with carbohydrates being broken down in the fibre, whose strength is reduced. The aim of the impregnation is, in the first place, thoroughly to soak each chips so that it becomes susceptible, by diffusion, to the active cooking chemicals which, in the context of sulphate cellulose, principally consist of sodium hydroxide and sodium sulphide. Following diffusion, the active cooking chemicals dissolve the lignins (which bind the fibres together) so that a finished cooked pulp can be obtained.

However, certain of the lignins are more readily dissolved than are others. These readily dissolved lignins can be dissolved both by sodium sulphide and by sodium hydroxide. However, other lignins, which are more difficult to dissolve, require sodium hydroxide as the dissolving agent. The disadvantage of sodium hydroxide is that, as has already been described, it also attacks carbohydrates (as early as the heating-up span 120°–140° C.) resulting in the strength of the fibres being decreased. The sodium sulphide, on the other hand, in the main attacks the lignin rather than the carbohydrates (at cooking temperature, i.e. greater than about 150° C.), and does not, therefore, have the same fibre-weakening effect.

It has long been known that the spent liquor from a sulphate cellulose cook, i.e. black liquor, contains a very small residual quantity of sodium hydroxide but a relatively large proportion of sulphides.

By using black liquor as an impregnation liquid, the advantage is thus achieved that certain readily soluble lignins are dissolved at the same time as the fibre strength is essentially preserved. Over and above this, important gains can be made purely from the point of view of heat economy by utilizing the heat in the hot drawn-off black liquor directly by supplying it for impregnation essentially without any cooling. An additional advantage of black liquor impregnation is that very even soaking of the chips is obtained at a relatively high temperature so that the white liquor, when it is added, can diffuse very rapidly into each individual chips piece. In our above-described application, an account is given of a process in which we have attempted to exploit the abovementioned advantages associated with black liquor impregnation.

However, there are certain disadvantages from the point of view of equipment in the process which we previously proposed, inter alia the existence of central pipes which are arranged at the top and hang downwards.

SOLUTION AND ADVANTAGES

We have now found that by using a two-vessel system, in which the actual cooking vessel is a steam/liquor-phase system, substantial advantages can be gained when cooking sulphate cellulose pulp from a preceding black liquor impregnation when white liquor is supplied to the fibre material at the top of the digester so that, inter alia, the advantage is gained that the bottom scraper in the impregnation vessel does not have any real influence in diminishing the fibre strength of the fibre material, since substantially no white liquor is present at that juncture.

Additionally, in accordance with a preferred embodiment of the invention, the requirement for central pipes can be eliminated, making an installation much simpler and considerably cheaper.

DESCRIPTION OF THE FIGURES

In that which follows, reference will be made to the enclosed figures in which.

DETAILED DESCRIPTION

Figure 1:
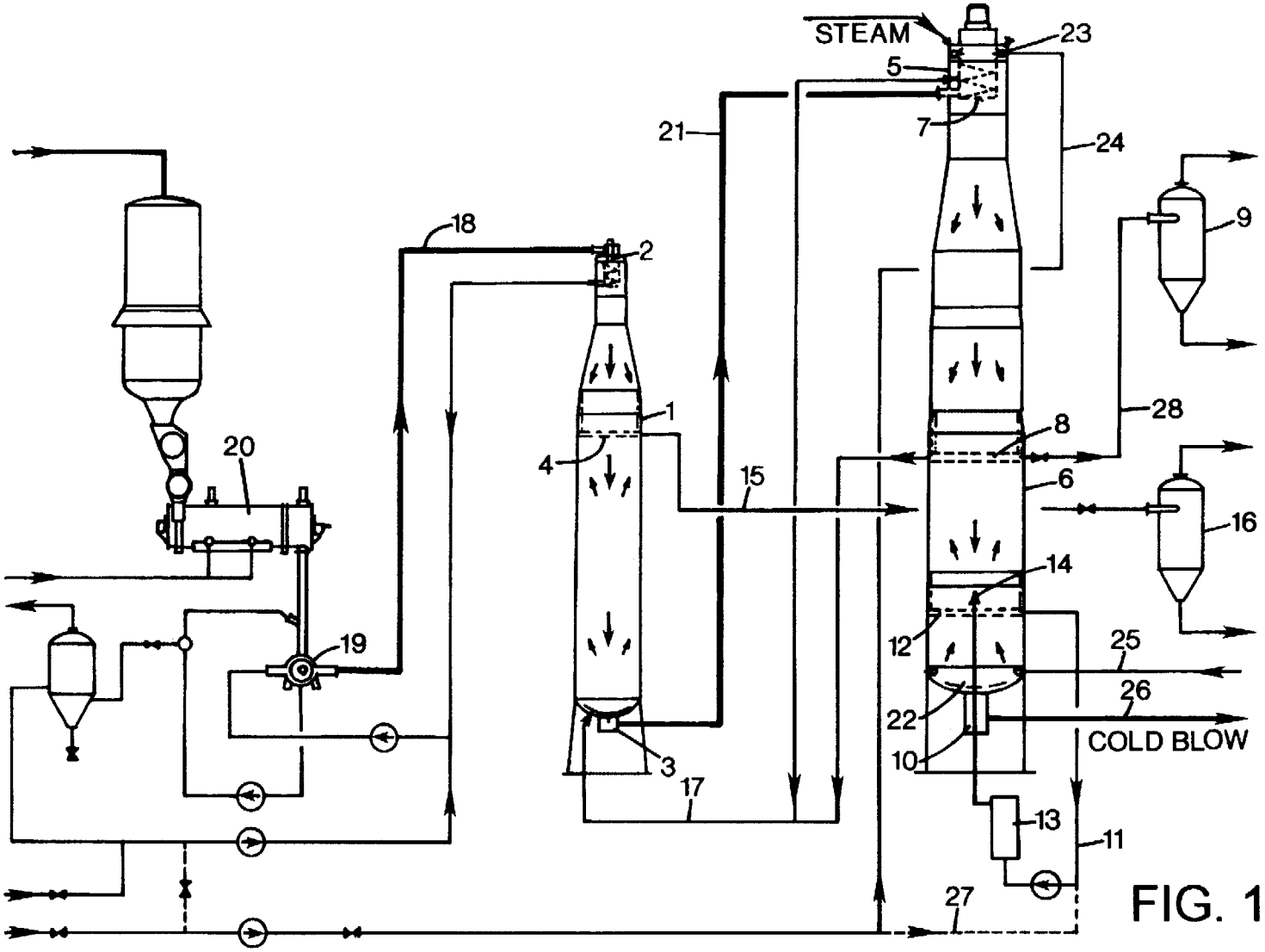
FIG. 1 shows a preferred embodiment of a continuous digester house according to the invention.

FIG. 1 shows a preferred embodiment of a part of a fibre line for producing chemical pulp according to the invention. The most important main components in the system consist of an impregnation vessel 1 and a steam/liquid-phase digester 6. The impregnation vessel 1 possesses a feeding-in device 2 at the top, which feeding-in device is of a conventional type, i.e. a top separator with screw-feed device which feeds the chips in a downward direction at the same time as transport liquid is drawn off. At the bottom, the impregnation vessel possesses a feeding-out device 3 comprising a bottom scraper. In addition to this, there is a conduit 17 for adding hot black liquor at the bottom. As seen the black liquor is preferably supplied to the bottom scraper of the impregnation vessel. A draw-off screen 4 is located somewhere in the central section of the impregnation vessel, which screen is connected to a departure conduit 15 which in turn leads to a flash cyclone 16. The chips are fed to the impregnation vessel via a conduit 18 which is connected to a high-pressure feeder 19. The feeder 19 is arranged in a known manner via a chute under a steaming vessel 20, and is connected to necessary liquid circulations and replenishment.

A conduit 21 for transporting chips leads from the bottom of the impregnation vessel 1 up to the top 5 of the digester 6. The conduit 21 opens out at the bottom of a feeding device 7 which feeds by means of a screw in an upwardly moving direction. The screen is used to draw off the liquid together with which the chips are transported up to the top. Approximately on a level with, and appropriately somewhat above, the upper edge of the screen (over which edge the chips tumble out), there is arranged an annular ring 23 provided with holes. The annular ring 23 is connected to a conduit 24 which leads to a white-liquor container (not shown). All the abovementioned cooking apparatus is located in the actual steam space in the digester 6. A screen girdle section 8 is arranged in conjunction with a step-out approximately in the middle of the digester 6. Draw-off from this screen girdle section 8 can be conducted directly via conduit 17 to the impregnation vessel 1 and/or via conduit 28 to a second flash cyclone 9. At the bottom 10 of the digester, there is a feeding-out device including a scraping element 22, which element is preferably integrated with a standpipe 14.

According to a preferred alternative, "cold-blow" is carried out, the temperature of the pulp being cooled down at the bottom of the digester with the aid of relatively cold (preferably 70°–80° C.) liquid which is added by means of the scraping element 22 and/or other liquid-adding devices 25 (appropriately annular pipes) at the bottom, and then subsequently conducted upwards in countercurrent. With the aim of being able to produce ITC™ pulp (high-quality pulp having a low kappa number) a so-called high-heat zone (preferably having essentially the same temperature as in the rest of the cooking zone) is maintained as far down as possible in the lower part of the digester with the aid of a lower circulation 11, 12, 13, 14, a so-called ITC™ circulation. This lower circulation consists of a screen girdle section 12 which is arranged at sufficient height above the lower liquid-addition point 22 and/or 25 to permit the attainment of a desired flow from the latter liquid-addition point towards the screen section 12, which height depends on the shape of the digester bottom (spherical bottom or not) and its diameter. Normally, the middle of the screen section should then be about 3–5 meters above the scraping element 22, and in extreme instances be placed more than 2 meters above the scraper 22 but less than 7 meters above the latter. The draw-off from the said screen girdle 12 is recirculated (for displacing black liquor in countercurrent to the draw-off screen 8) into the digester with the aid of a standpipe 14 which opens out approximately on a level with the said screen girdle section 12. For constructional reasons, attempts should be made to keep the length of the pipe 14 as short as possible, but, in conformity with that which has been discussed above, the length should not be less than about 2 meters. In order to be able to withstand momentary large lateral forces, the thickness of the material should exceed 10 mm, preferably exceed 14 mm, and/or be stiffened/strengthened with the aid of structures arranged inside the pipe 14. A heat exchanger 13 for temperature regulation (raising the temperature of the re-introduced liquid) and a pump are also located in the conduit 11 which connects the screen girdle 12 with the pipe 14. The recirculation loop 11 is also connected via a branch conduit 26 to the white liquor supply so that fresh alkali can be supplied and, in the form of countercurrent cooking, offer the possibility of further reducing the kappa number. The digester construction described is notable for the lack of central pipes arranged from above and hanging downwards, as well as of feed pipes connected to them and of other necessary parts for the circulations.

A preferred installation according to the invention functions as follows. The chips are fed in a conventional manner into a chips silo and conveyed via the steaming vessel 20 and a chute to the high-pressure feeder 19 (which in a known manner is supplied with a minor amount of white liquor in order to lubricate it), with the aid of which the chips are fed into conduit 18 together with the transport liquid. The chips and the liquid which have been fed to the top of the impregnation vessel in this way have a temperature of about 110°–115° C. and a liquid/wood ratio of about 3.5/1 on entry to the digester (excluding recirculated transport liquor).

The optimal temperature for the "slurry" depends on the pressure which is being maintained in the steaming vessel. Specifically, the temperature should not exceed the steam-formation value for the pressure prevailing in the chute down to the high-pressure tap since, otherwise, "bangs" can occur in connection with volatilization towards the chute from the steaming vessel. According to a preferred embodiment, a positive pressure of about 1–2 bar is employed, with a suitable temperature at the top of the impregnation vessel consequently being about 110°–115° C.

In addition to the actual fibres in the wood, the latter also conveys its own moisture (the wood moisture), which constitutes about 50% of the original weight, to the impregnation vessel. Over and above this, condensate is present from the steaming, i.e. at least a part of the steam (principally low-pressure steam) which was supplied to the steaming vessel is cooled down to such a low level that it condenses and is then recovered as liquid together with the wood and the transport liquid.

In the feed-in screen, which is of conventional type and feeds from above and downwards with the aid of a screw, liquid is drawn off and recirculated to the high-pressure feeder 19 for use as new transport liquid. The transport liquid consists principally of chips moisture, condensate and make-up.

The chips which are fed out from the bottom of the top screen then move slowly downwards in a plug flow through the impregnation vessel 1 in a liquid/wood ratio of about 3.5/1. Hot black liquor, which is drawn off from the draw-off screen 8 of the digester, is added, via conduit 17, low down in the impregnation vessel 1, preferably at the bottom. The hot black liquor displaces away, in countercurrent to the chips column, condensate, transport liquid and wood moisture, which are drawn off with the aid of the draw-off screen girdle 4 of the impregnation vessel. The high temperature of the black liquor, preferably exceeding 150°, more preferably about 160° C., ensures rapid heating of the chips, in turn permitting efficient displacement of the wood moisture. In addition, the relatively high pH, exceeding pH 10, of the black liquor means that any acidic condensate accompanying the chips is neutralized, thereby counteracting the formation of incrustations, so-called scaling. An additional advantage of using black liquor in the impregnation vessel is that the high content of sulphide as compared with that of hydroxide in the black liquor has the consequence that the strength properties of the fibres are not affected negatively by the impregnation since the sulphides, in contrast to the hydroxide, do not attack the carbohydrates in the fibres and only attack certain readily soluble lignins. Furthermore, this removes the disadvantages which are associated with using white liquor for the major part of the liquid in the impregnation and which are seen in a loss of fibre strength in connection with the mechanical effect which the bottom scraper in the impregnation vessel 1 exercises on the chips during feeding-out and transfer to the top of the digester 6. The quantity of black liquor being fed to the impregnation vessel 6 is preferably regulated using the temperature of the draw-off from the draw-off screen. Preferably, the temperature of the drawn-off liquid should exceed the temperature of the mixture which is fed in at the top, which is suitably regulated using the flow from the draw-off screen 2. Since the impregnation vessel is completely filled, hydraulically, with liquid, an increase in the draw-off from this vessel will automatically signify an increase in the quantity of black liquor which is supplied to the impregnation vessel. In order to be completely sure of obtaining a good degree of thorough impregnation, the temperature of the drawn-off liquid should be about 10° C. above the temperature of the liquid/wood mixture fed in at the top 2 of the impregnation vessel 1.

The chips, which have been thoroughly impregnated and partially delignified in this way, are fed to the top of the digester 6 and conveyed into the upwardly-feeding top screen. The chips are thus fed upwards through the screen and finally fall out over the edge of the screen down through the steam space. Here, too, it is preferred to attempt to maintain a liquid/wood ratio of about 3.5/1 (between 2.5–4.5/1). During their free fall, the chips pieces are showered with white liquor (which is known per se through SE-B-330819, which does not, however, relate to black liquor impregnation) which is supplied by means of the perforated annular pipe 23. The quantity of white liquor which is added here depends on how much white liquor possibly is added else where, but the total amount corresponds to the quantity of white liquor which is required for achieving desired delignification of the wood. Preferably a major part of it is added here, i.e. more than 50%, which also improves the diffusion velocity, since it increases exponentially in relation to the concentration difference(chip-surrounding liquid). The thoroughly impregnated chips now very rapidly assimilate the active cooking chemicals by diffusion and then move down in co-current through the digester 6 while maintaining an optimal cooking temperature, about 155°–160° C. The major part of the delignification takes place in the first, relatively long (in relation to conventional digesters) co-current cooking zone. The cooking liquid mingled with released lignins, etc., is drawn off at the draw-off screen 8 as a result of the liquid which was fed in in countercurrent using the pipe 14 having displaced it from the wood upwards towards the draw-off screen 8. This results, consequently, in the delignification being prolonged in the digester 6. A Prerequisite for obtaining this prolonged cooking is that the temperature in this lower zone is sufficiently high, i.e. preferably exceeding 140° C., preferably about 150°–160° C., in order to dissolve lignin. In the preferred case, the aim is to maintain essentially the same temperature in all the cooking zones (so-called ITC™ cooking, ITC=IsoThermal Cooking), consequent upon which there are many advantages such as good pulp quality, low chemical consumption, low energy consumption, etc. Expediently, the lower circulation 11, 12, 13, 14 is charged with about 5–20%, preferably 10–15%, white liquor. The temperature of the liquid which is recirculated via the pipe 14 is regulated with the aid of a heat exchanger 13 so that it corresponds approximately to the cooking temperature.

In the preferred case, "cold-blow" is used, with the temperature of the pulp in the outlet conduit 26 being less than 100° C. Accordingly, washing liquid having a low temperature, preferably about 70°–80° C., is added in a known manner using the scraping element and an outer annular conduit 25 arranged at the bottom. This liquid consequently displaces the boiling hot liquor in the pulp upwards in countercurrent and thereby imparts a temperature to the remaining pulp which can be cold-blown, i.e. depressurized and disintegrated without any real loss of strength.

Figure 2:
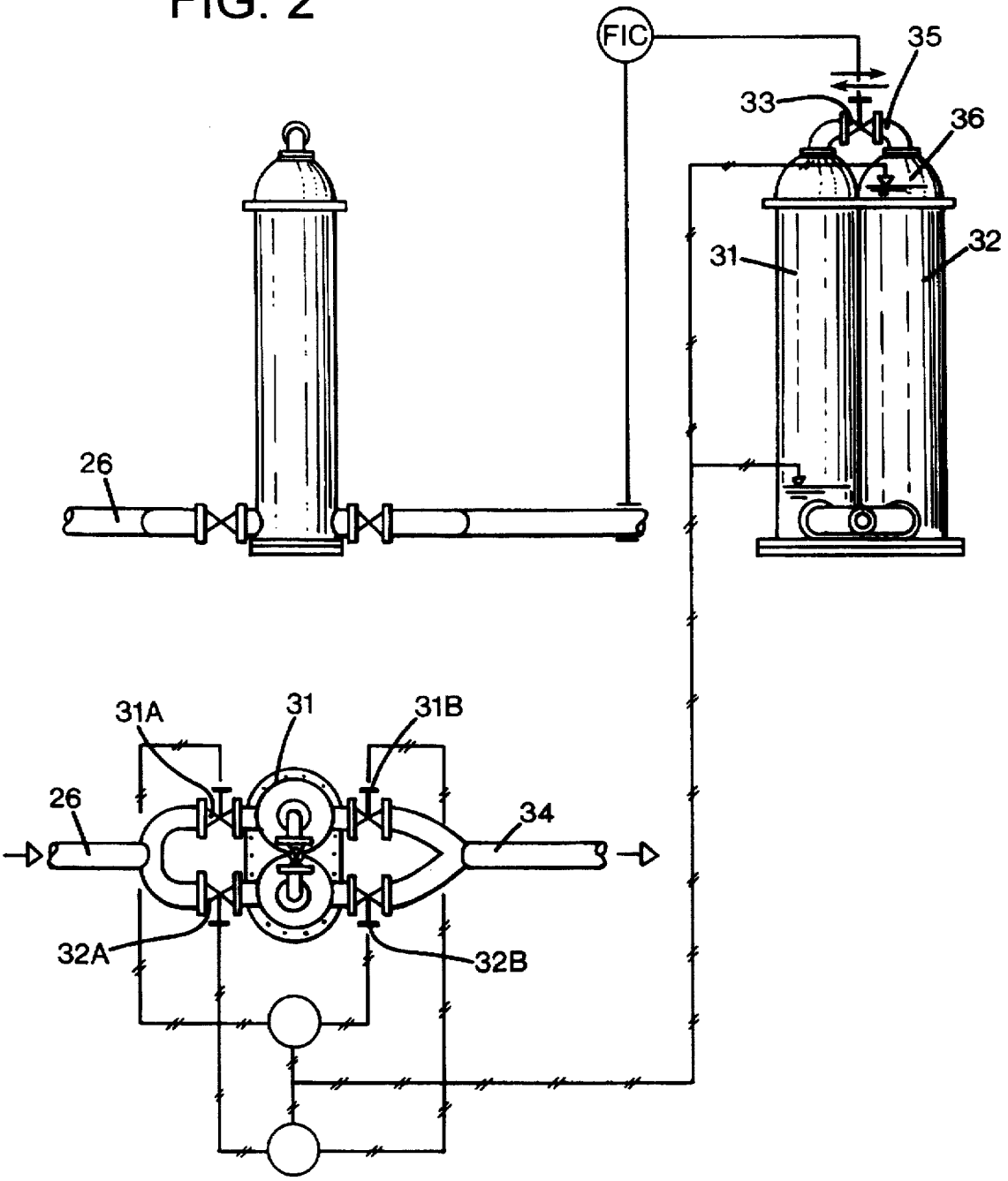
FIG. 2 shows an alternative embodiment in accordance with a "no-blow" system which is expected to make an additional contribution to reduction of fibre degradation, especially with regard to types of wood having long fibres.

FIG. 2 shows an alternative embodiment according to the invention in which cold blowing is not used and, instead, the pulp is fed out without blowing. The figure shows that the pulp taken out of the digester 6 via conduit 26 is conveyed in a conduit 30 to one of two vessels 31, 32. The pulp is fed continuously into one of the two vessels 31, 32. Four valves 31A, 31B, 32A, 32B regulate the process. When one of the vessels 31 is being fed with new pulp, the other vessel 32 is being emptied. The pressure is released with the aid of the valve 33, which is a throttle valve which is arranged in a conduit 35 which connects the two vessels at the top and only throttles in liquid phase 36 without the presence of fibres. The valves open and close in pairs, with 31A and 32B being open when 31B and 32A are closed, and vice versa. Thus, valves 31A and 32B are simultaneously open when pulp is being fed into the vessel 31. At the same time, pulp flows out of the container 32 into the conduit 34. At the same time as the pulp is fed out from container 32, the pressure on the pulp in the container 31 is released through the valve 33. As soon as the one vessel is nearly full and the other vessel 32 is nearly empty, valves 32B and 31A close and 32A and 31B open for the feeding-in of new pulp, and for feeding-out, respectively, thereby initiating a new cycle (the principle is known per se from our patent SE 183493). From some test made in labscale, however, we have found indications that under some circumstances it would be desired to keep the alkaline level at above at least 2 g/l, preferably 4 g/l, in the impregnation vessel in connection with black liquor, which would normally correspond to a pH of about 11. If not it appears that dissolved lignins percipitate in a manner so as to form some kind of "protective" layer around the chips. Accordingly in such a situation, either white liquor preferably should be added (although this alternative would normally not be desired if focusing on strength properties) to the impregnation vessel, or should the drawn off black liquor which is added at the bottom contain a sufficient amount of rest alkaline in order to not be consumed below said alkaline level during its movement upwards through the chips column. This can be achieved in many different ways, e.g. by measuring the alkaline level of the drawn off liquid 15 from the impregnation vessel 1 and controlling the added amount (preferably in the digester) and position of supply in dependence thereof. According to a preferred embodiment ITC™ (PCT/SE93/00816 and PCT/9300978) is used which means that about 15–30% of the white liquor is added in a lower countercurrent zone. By using ITC it also easier to adjust the rest alkaline level of the drawn off black liquor 8 to a relatively high level which then could be adapted to the above requirements.

The invention is not limited to that which has been shown above but can be varied within the scope of the subsequent patent claims. Thus, there are a multiplicity of alternatives to the perforated annular pipe 23 which has been shown for uniformly drenching the chips with white liquor. For example, a centrally arranged inlet having a spreading device can be contrived, which device, in a known way, provides a mushroom-like film of liquid, as can a centrally arranged showering element or an annular pipe with slots, etc. In addition, it will be evident to a person skilled in the art that the number of screen girdles shown is in no way limiting for the invention but, instead, the number can be varied in dependence on different requirements. It is likewise obvious that the invention is in no way limited to a certain screen configuration and it is understood that bar screens, for example, such as screens having slots cut out of sheet metal, can be used. Also in some installations moveable screens are preferred. Furthermore, it will be evident to the person skilled in the art that, in order to amplify the ITC™ effect, measures can be taken which decrease heat losses from the digester, such as, for example, insulation of the digester shell and/or maximization of the volume in relation to the outwardly exposed surface, i.e. increasing the cross-sectional area. Furthermore it is possible to exclude the steaming vessel 20 and have a direct connection between the chip bin and the chip chute. In order to improve the distribution of the white liquor added at the top, it is possible to install a so called "quench circulation" which would recirculate a desired amount of liquid from below the top screen 7 back to the annular pipe 23. For this purpose ordinary screens is not a requirement. Finally if severe foaming problems would occur, this might be eliminated by supplying all or some of the hot black liquor to the impregnation from after the first flashing device 9 (whereby the black liquor is degassed).

We claim:

1. A method for continuously producing pulp, comprising the steps of:

providing a finely divided fiber material and an impregnation vessel having a top and a bottom, the impregnation vessel maintaining a cooking pressure;

providing at least one draw-off screen disposed in the impregnation vessel;

providing a steam phase digester having a top and a bottom and at least one screen disposed therein, the steam phase digester being adapted to facilitate a cooking reaction, the screen being adapted to drawing off black liquor;

providing a feeding device disposed at the top of the steam phase digester;

providing a black liquor and a cooking liquor, an amount of the cooking liquor being required for the cooking reaction;

feeding in the fiber material at the top of the impregnation vessel;

while feeding in the fiber material, transferring the black liquor from the steam phase digester to the impregnation vessel;

while feeding in the fiber material, heating and thoroughly impregnating the fiber material disposed in the impregnation vessel by exposing the fiber material to the black liquor injected in a direction that is counter current to a flow of the fiber material;

while heating and impregnating the fiber material, drawing off a liquid at the draw-off screen disposed in the impregnation vessel;

while drawing off the liquid, feeding out impregnated fiber material from the bottom of the impregnation vessel;

while feeding out impregnated fiber material, transferring impregnated fiber material from the bottom of the impregnation vessel to the top of the steam phase digester;

while transferring impregnated fiber material, separately supplying at least 50% of the amount of cooking liquor required for the cooking reaction directly to the top of the steam phase digester, the cooking liquor being supplied as finely divided drops;

while supplying cooking liquor directly to the top of the steam phase digester, drawing off the black liquor at the screen; and feeding out pulp at the bottom of the steam phase digester.

2. The method according to claim 1 wherein step of providing a finely divided fiber material includes the step of providing wood chips.

3. The method according to claim 1 wherein at least 60% of the amount of the cooking liquor required for the chemical reaction is supplied separately to the feeding device of the steam phase digester.

4. The method according to claim 1 wherein at least 70% of the amount of the cooking liquor required for the chemical reaction is supplied separately to the feeding device of the steam phase digester.

5. The method according to claim 1 wherein the step of transferring the fiber material to the steam phase digester includes feeding in the fiber material in an upward direction within the top of the steam phase digester and permitting a free fall of the fiber material from the feeding device.

6. The method according to claim 1 wherein the step of drawing off the black liquor from the steam phase digester includes drawing off black liquor from the steam phase digester and supplying at least a part thereof directly to the impregnation vessel.

7. The method according to claim 6 wherein the step of supplying black liquor includes the step of supplying the black liquor at a temperature exceeding 140 degrees Celsius.

8. The method according to claim 6 wherein the step of supplying black liquor includes the step of supplying the black liquor at a temperature exceeding 150 degrees Celsius.

9. The method according to claim 6 wherein the step of supplying black liquor includes the step of supplying the black liquor at a temperature between 155 degrees Celsius and 165 degrees Celsius.

10. The method according to claim 6 wherein the method further includes the step of supplying a liquid to the top of the impregnation vessel and the step of supplying black liquor to the impregnation vessel includes the step of regulating the supply of black liquor by measuring a first temperature of the liquid drawn off from the impregnation vessel so that the first temperature is higher than a second temperature of the liquid supplied to the top of the impregnation vessel.

11. The method according to claim 10 wherein the first temperature is at least five degrees Celsius higher than the second temperature.

12. The method according to claim 10 wherein the first temperature is at least ten degrees Celsius higher than the second temperature.

13. The method according to claim 1 wherein the method further includes the step of providing a washing liquid and the step of feeding out pulp includes supplying the washing liquid to the bottom of the steam phase digester, the washing liquid having a temperature that is below 100 degrees Celsius to facilitate cold blowing the pulp.

14. The method according to claim 13 wherein the washing liquid has a temperature that is below 85 degrees Celsius.

15. The method according to claim 13 wherein the washing liquid has a temperature that is between 70 degrees Celsius and 80 degrees Celsius.

16. The method according to claim 13 wherein the method further includes the step of providing a lower cooking liquor circulation unit, a screen arrangement disposed at the bottom of the steam phase digester, a heating device in operative engagement with the steam phase digester and a stand pipe disposed within the steam phase digester and the step of supplying the washing liquid includes drawing off liquid through the screen arrangement and recirculating the liquid with the aid of the heating device and discharging the liquid through the stand pipe at a level that is adjacent the screen arrangement.

17. The method according to claim 1 wherein the method further includes providing a separate flash device in operative engagement with the impregnation vessel, the step of drawing off the liquid from the impregnation vessel includes conveying the liquid to the separate flash device.

18. The method according to claim 1 wherein the step of supplying the cooking liquor includes separately supplying at least 80% of the amount of liquor required for the cooking reaction to the feeding device of the steam phase digester in the form of finely divided drops.

19. The method according to claim 1 wherein the step of supplying the cooking liquor includes separately supplying at least 90% of the amount of liquor required for the cooking reaction to the feeding device of the steam phase digester in the form of finely divided drops.

20. The method according to claim 1 wherein the step of supplying the cooking liquor includes separately supplying 100% of the amount of liquor required for the cooking reaction to the feeding device of the steam phase digester in the form of finely divided drops.

21. A device for continuously cooking pulp, the device comprising:

an impregnation vessel having a top and a bottom, the impregnation vessel maintaining a cooking pressure, the top of the impregnation vessel being adapted for receiving a finely divided fiber material suspended in a liquid;

a draw-off screen disposed in the impregnation vessel for drawing off liquid from the impregnation vessel;

a steam phase digester having a top and a bottom, the top of the steam phase digester being in fluid communication with the bottom of the impregnation vessel;

a feeding device disposed at the top of the steam phase digester, the feeding device being adapted to supply a hot black liquor to the bottom of the impregnation vessel so that the hot black liquor is discharged into the impregnation vessel in a flow direction that is counter current to a flow direction of the fiber material flowing through the impregnation vessel so that the fiber material is impregnated by the hot black liquor, the bottom of the impregnation vessel being adapted for feeding out impregnated fiber material to the top of the steam phase digester;

a screen disposed in the steam phase digester and adapted to draw off black liquor from the steam phase digester;

a conduit in fluid communication with the top of the steam phase digester for supplying the steam phase digester with at least 50% of an amount of cooking liquor required for a cooking reaction in the steam phase digester to convert the impregnated fiber material to pulp, the cooking liquor being supplied directly to the top of the steam phase digester and having the form of finely divided drops; and the steam phase digester being constructed in a manner so as to be free of a central pipe extending from the top of the steam phase digester and downwardly.

22. The device according to claim 21 wherein the steam phase digester further comprises a circulation unit including a heating device having an opening defined therein that is on a level with a lower screen disposed in the steam phase digester, the device further including a pipe disposed at the bottom of the steam phase digester.

23. The device according to claim 22 wherein the pipe is integral with a scraper device disposed in the steam phase digester.

24. A method for continuously producing pulp, comprising the steps of:

providing a finely divided wood chips and an impregnation vessel having a top and a bottom, the impregnation vessel maintaining a cooking pressure;

providing at least one draw-off screen disposed in the impregnation vessel;

providing a steam phase digester having a top and a bottom and at least one screen disposed therein, the steam phase digester being adapted to facilitate a cooking reaction, the screen being adapted to drawing off black liquor;

providing a feeding device disposed at the top of the steam phase digester;

providing a black liquor having a temperature of between 155 degrees Celsius and 165 degrees Celsius, and a cooking liquor, an amount of the cooking liquor being required for the cooking reaction;

providing a separate flash device in operative engagement with the impregnation vessel;

feeding in the wood chips at the top of the impregnation vessel;

while feeding in the wood chips, transferring the black liquor from the steam phase digester to the impregnation vessel and regulating the supply of black liquor by measuring a first temperature of the liquid drawn off from the impregnation vessel so that the first temperature is at least ten degrees Celsius higher than a second temperature of the liquid supplied to the top of the impregnation vessel;

while transferring the hot black liquor, heating and thoroughly impregnating the wood chips disposed in the impregnation vessel by exposing the wood chips to the black liquor injected in a direction that is counter current to a flow of the wood chips;

while heating and impregnating the wood chips, drawing off a liquid at the draw-off screen disposed in the impregnation vessel and conveying the liquid to the separate flash device;

while drawing off the liquid, feeding out impregnated wood chips from the bottom of the impregnation vessel;

while feeding out impregnated wood chips, transferring impregnated wood chips from the bottom of the impregnation vessel to the top of the steam phase digester and feeding in the fiber material in an upward direction within the steam phase digester and permitting a free fall of the wood chips from the feeding device;

while transferring impregnated wood chips, separately supplying at least 90% of the amount of cooking liquor required for the cooking reaction directly to the feeding device disposed at the top of the steam phase digester, the cooking liquor being supplied as finely divided drops;

while supplying cooking liquor, drawing off black liquor from the steam phase digester and supplying at least a part thereof directly to the impregnation vessel; and while drawing off black liquor, feeding out pulp at the bottom of the steam phase digester and supplying washing liquid to the bottom of the steam phase digester, the washing liquid having a temperature that is between seventy and eighty degrees Celsius to facilitate cold blowing of the pulp.

* * * * *